US005231819A

United States Patent [19]

Stahlecker et al.

[11] Patent Number: 5,231,819

[45] Date of Patent: Aug. 3, 1993

[54] SPINNING OR TWISTING MACHINE WITH ELECTRIC MOTOR DRIVES

[75] Inventors: Hans Stahlecker, Haldenstrasse 20, 7334 Süssen; Gerd Stahlecker, Eislingen/Fils, both of Fed. Rep. of Germany

[73] Assignees: Fritz Stahlecker; Hans Stahlecker, Fed. Rep. of Germany

[21] Appl. No.: 885,237

[22] Filed: May 20, 1992

Related U.S. Application Data

[63] Continuation of Ser. No. 626,457, Dec. 12, 1990, abandoned.

[30] Foreign Application Priority Data

Dec. 23, 1989 [DE] Fed. Rep. of Germany ..... 3942914

[51] Int. Cl.[5] ..... D01H 13/00; H02G 3/00

[52] U.S. Cl. ..... 57/100; 174/101; 174/99 R; 310/112

[58] Field of Search ..... 57/81, 100, 129, 112, 57/1 R, 264, 265, 75; 174/101, 95, 97, 99 R; 310/112, 114

[56] References Cited

U.S. PATENT DOCUMENTS

| | | | |
|---|---|---|---|
| 3,936,995 | 2/1976 | Laflaquiere et al. | 57/1 R |
| 4,348,860 | 9/1982 | Hartmannsgruber | 57/1 R X |
| 4,888,452 | 12/1989 | Krehl et al. | 174/101 |
| 4,982,562 | 1/1991 | Mette et al. | 57/100 X |

FOREIGN PATENT DOCUMENTS

| | | | |
|---|---|---|---|
| 548109 | 4/1931 | Fed. Rep. of Germany | 57/100 |
| 2845933 | 4/1980 | Fed. Rep. of Germany . | |
| 2292088 | 7/1976 | France | 174/97 |

*Primary Examiner*—Daniel P. Stodola
*Assistant Examiner*—Michael R. Mansen
*Attorney, Agent, or Firm*—Evenson, McKeown, Edwards & Lenahan

[57] ABSTRACT

In the case of a spinning or twisting machine, it is provided that the spindles are each driven by separate electric motors which, together with their bearings, are arranged in a spindle rail constructed as a longitudinal duct, the stators and the rotors of the electric motors being disposed in the longitudinal duct in an exposed manner.

27 Claims, 2 Drawing Sheets

SPINNING OR TWISTING MACHINE WITH ELECTRIC MOTOR DRIVES

This is a continuation of application Ser. No. 07/626,457, filed Dec. 12, 1990, now abandoned.

BACKGROUND AND SUMMARY OF THE INVENTION

The invention relates to a spinning or twisting machine which has a plurality of spindles arranged in a row next to one another, each of the spindles being driven by a separate electric motor, and their bearings, together with the electric motors, being arranged in a spindle rail designed as a longitudinal duct.

In the case of a known spinning or twisting machine of the initially mentioned type (German Patent Document DE-A 28 45 933), the two front-side end shields of the casing of the electric motors are arranged on the spindle rail to be radially adjustable on all sides independently of one another. As the spindle rail, a longitudinal duct is used having a rectangular cross-section, one end shield being mounted directly in the bottom of the longitudinal profile, and the other end shield being mounted by means of a lid-type holding device on the top side of the longitudinal duct.

It is an object of the invention to reduce the manufacturing expenditures for a spinning or twisting machine of the initially mentioned type.

This object is achieved in preferred embodiments of the invention by providing that the stators and the rotors of the electric motors are arranged in the longitudinal duct in an exposed manner.

Because of this design, it is possible to do without any individual casings for the electric motors since their elements are arranged sufficiently inside the longitudinal duct which then serves as the casing with respect to prevent damage as well as contact by the operator. As a result of the elimination of separate motor casings, material expenditures are reduced while, in addition, servicing operations are facilitated.

In a further development of the invention, it is provided that the longitudinal duct is divided into at least two partial ducts, of which one partial duct contains the exposed stators and rotors of the electric motors, and the other partial duct or ducts contain the electric supply lines, the control lines and the control elements for the electric motors. By means of this development it is achieved that the spindle rail is provided with an additional function, specifically the function of a cable duct. This results in an attractive appearance while, in addition, the required electrical devices are arranged in a clear and protected manner.

In a further development of the invention, it is provided that the longitudinal duct consists of an essentially Y-shaped extruded profile, the upper section of which accommodates the electric motors and the lower section of which accommodates the supply lines, the control lines and the control elements, and in that the two sections are closed by detachable lids. In an expedient further development, it is also provided that the upper section has a horizontal bottom on which the spindle bearing housings are held. Expediently, the stators, with their bundles of laminations, are in this case fastened on webs of the profile which project upward from the bottom. As a result, a very simple and compact construction is achieved. This type of an extruded o drawn profile which preferably may be made of aluminum, requires very few cutting operations so that the manufacturing may be carried out at reasonable costs.

In a further development of the invention, it is provided that the longitudinal duct is joined together from bent metal sheets, and in that holding parts are mounted on a partition between an upper partial duct and a lower partial duct which each carry spindle bearing housings of the spindles and stators of the electric motors. These holding parts, in each case, together with a spindle and the pertaining electric motor, i.e., also with the stator, will form a structural unit which may be installed and removed as a whole as necessary.

Other objects, advantages and novel features of the present invention will become apparent from the following detailed description of the invention when considered in conjunction with the accompanying drawings.

DETAILED DESCRIPTION OF THE DRAWINGS

Figure 1:
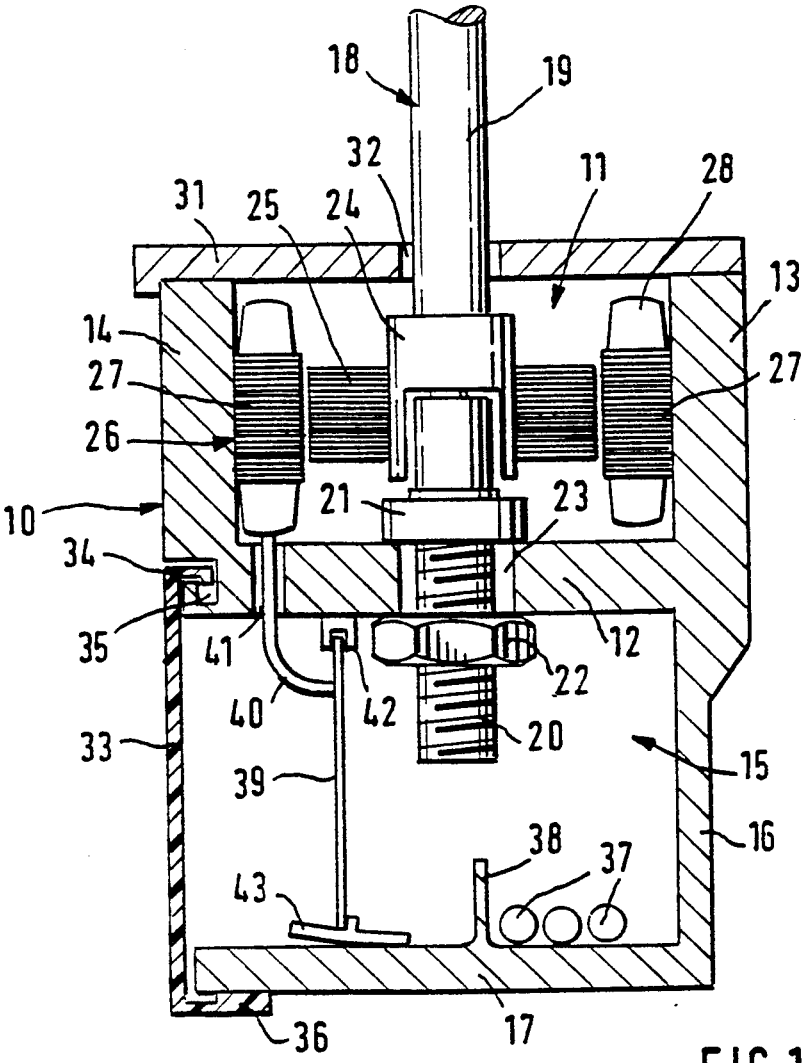
FIG. 1 is a schematic cross-sectional view of a first embodiment of the invention having a spindle rail made of an extruded metal profile.

In the embodiment according to FIG. 1, a Y-shaped profile is used as a spindle rail 10 of a spinning or twisting machine. The profile is produced as an extruded metal profile, particularly made of an aluminum alloy. The spindle rail 10 forms an upper partial duct 11 open toward the top which is bounded by a bottom 12 and two lateral webs 13, 14. Below this partial duct 11, another partial duct 15 is situated which is bounded by a web 16 extending as an extension of the upper web 13 and a leg 17 extending in parallel to the bottom. The spindle rail 10 which is joined together from several parts in the longitudinal direction of the machine and which extends from a machine end frame to another machine end frame, is used to accommodate a plurality of spindles 18 arranged in a row next to one another in the longitudinal direction of the machine, which spindles each have an individual electric motor drive.

The spindles 18 each have an upper spindle part 19 and a lower spindle part which is essentially formed of the spindle bearing housing 20. The spindle bearing housing 20 is provided with a fastening flange 21 and an external thread onto which a nut 22 is screwed. The spindle bearing housing 20 is fitted through a bore 23 of the bottom 12 of the upper partial duct 11 and is fastened by means of the fastening flange 21 and the nut 22.

The upper spindle part 19 is non-rotatably connected with a rotation body 24 which reaches over the spindle bearing housing 20 and on which a rotor 25 of the electric motor is fastened in a non-rotatable manner. A stator 26 is disposed opposite this rotor 25 while leaving an air gap, the stator 26 being formed from a bundle of laminations 27 and from windings 28. The bundle of laminations 27 of the stator 26 is inserted from above into the partial duct 11 and is fastened to the vertical webs 13, 14 of the metal profile which forms the spindle rail 10. The bundle of laminations 27 which is constructed in a manner not shown in detail by means of bolts and screws or the like to be one constructional unit with the winding 28, is pressed from above between the webs 13, 14.

Figure 2:
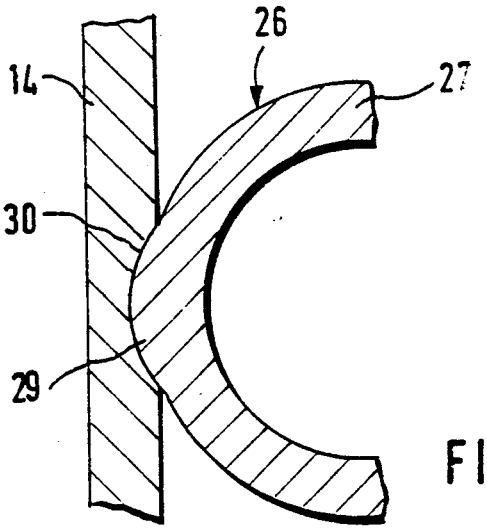
FIG. 2 is a partial longitudinal sectional view showing a detail of the embodiment according to FIG. 1.

As illustrated in FIG. 2, the bundle of laminations 27 is laterally provided with bead-type ribs 29 which engage in a groove-shaped indentation 30 of the webs 14 so that the stator 26 is secured against twisting.

A lid 31 rests on top of the webs 13, 14 and is provided with a passage bore 32 for the upper spindle part 19 which surrounds the upper spindle part 19 at a distance.

The lower partial duct 15 has a U-shaped cross-section which is open to the side, preferably to the operating side of the machine. This duct 15 is closed off by means of a lid 33 which is made of plastic or sheet metal and which is hung by means of a hook-shaped edge 34 into a groove-shaped recess 35 of the Y-shaped profile so that a type of swivel joint is formed in this area around which the lid 33 can be swivelled away in the upward direction. The lower edge of the lid 33, which preferably extends along the length of a profile section, that is, for example of a machine section, is bent toward the interior and by means of this bent end 36, reaches from below around the leg 17 of the Y-shaped profile.

The lower partial duct 15 houses the electric equipment elements for the electric motors of the individual spindles 18. As illustrated in FIG. 1, supply lines 37 extend in this partial duct 15. The area of the supply lines 37 is shielded from the remaining area of the partial duct 15 by means of a web 38 which is molded onto the leg 17 and is used as a shield. In the area of the partial duct 15 which faces the lid 33, control lines and control elements are provided which are arranged on motor boards 39. Lines 40 lead from these motor boards 39 to the windings 28 which are guided through openings 41 of the bottom 12. With their upper edge, the motor boards 39 are inserted into groove-shaped recesses of rails 42 which extend in the longitudinal direction of the spindle rail 10 and are mounted on the underside of the bottom 12. They are secured in these rails 42 by means of spring brackets 43 which are mounted on the interior side of the leg 17 extending in parallel to the bottom 12.

Figure 3:
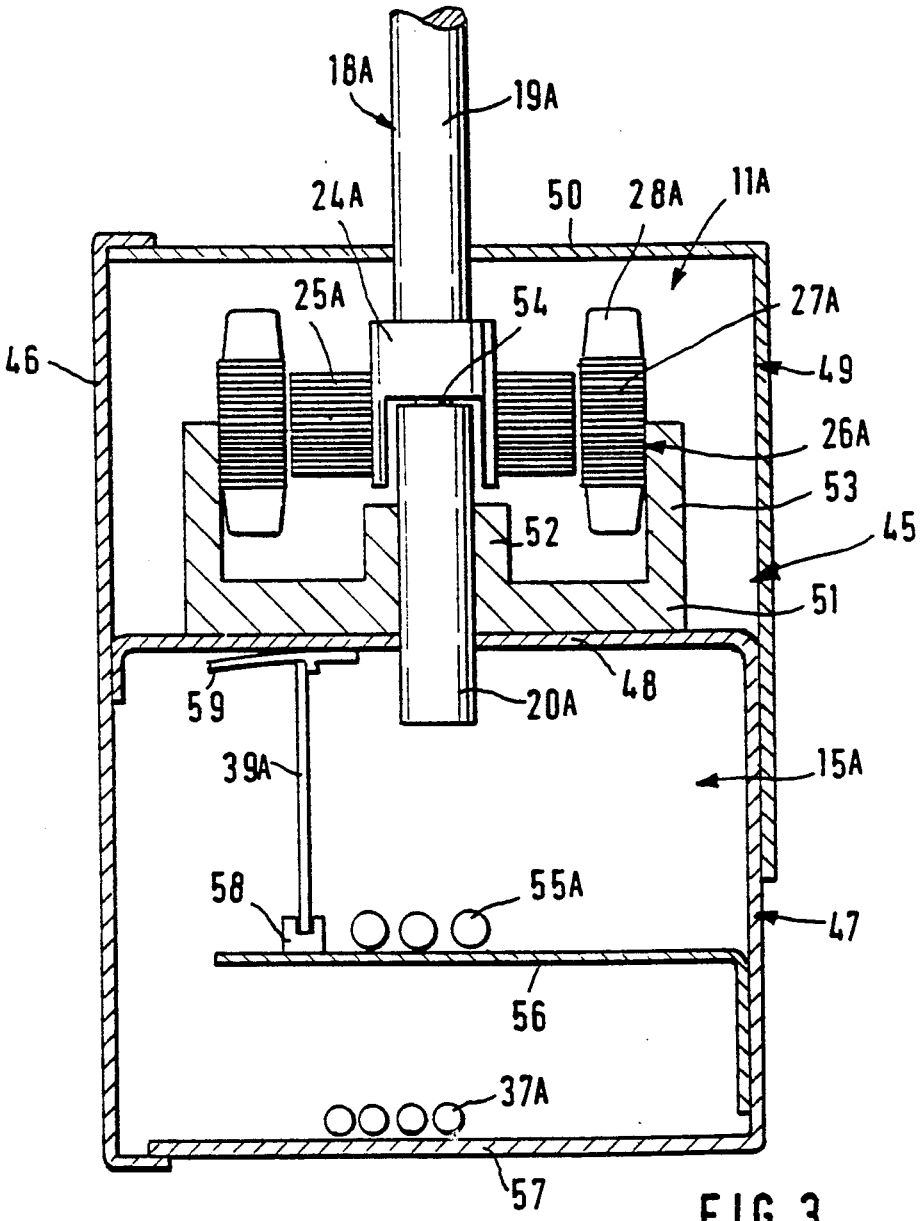
FIG. 3 is a schematic cross-sectional view of another preferred embodiment of the invention with a spindle rail joined together from sheet metal profiles which is divided into two partial ducts.

In the illustration of FIG. 3, like reference numerals with a suffix "A" are used to depict structure operating similarly to corresponding numbered structure of FIGS. 1 and 2. The embodiment according to FIG. 3 has a spindle rail 45 which is joined together from bent sheet metal profiles. This spindle rail 45 again has an upper partial duct 11A and a lower partial duct 15A. Both partial ducts 11A, 15A are each open toward the operating side and are covered by means of a common lid 46. The partial duct 15A is formed essentially from a sheet metal profile 47 which is open toward the operating side and is bent in a U-shape and the upper leg 48 of which forms the bottom for the upper partial duct 11A. An angular profile 49 is fastened to the rear of profile 47, the horizontal leg 50 of profile 49 forming the upper covering for the partial duct 11A.

Spindles 18A, including their electric-motor drives, are housed in the partial duct 11A. For each spindle 18A, a holding part 51 is arranged in the upper partial duct 11A and has a cup-shaped design and, in its center area, is provided with a bearing receiving device 52 for the spindle bearing housing 20A of the spindle 18A. In the shown embodiment, the spindle bearing housing 20A is pressed into this bearing receiving device 52. In a modified embodiment, a fastening corresponding to the embodiment of FIG. 1 is provided; i.e., the spindle bearing housing 20A will then be provided with a fastening flange 21 and an external thread onto which a nut can be screwed.

The upwardly projecting walls 53 of the cup-shaped holding part 51 are used for receiving the stator 26A of the electric-motor drives which each comprise a bundle of laminations 27A and a winding 28A corresponding to the embodiment according to FIG. 1. The fastening takes place on the bundle of laminations 27A.

A rotor 25A is assigned to the stator 26A and is arranged on a rotation body 24A of the upper spindle part 19A which, in turn, is non-rotatably connected with a spindle shaft 54 disposed in the spindle bearing housing 20A. The holding part 51 is preferably produced as a die-cast part from aluminum or an aluminum alloy.

In the partial duct 15A, supply lines 37A and control lines 55A are housed which are used for supplying the individual electric-motor drives. The partial duct 15A is divided by means of an angular profile 56, the one leg of which extends in parallel to the lower leg 57 of profile 47. As a result, the supply lines 37A are shielded with respect to the control lines 55. In the area which is shielded with respect to the supply lines 37A, the motor boards 39A are also situated which, in a manner not shown in detail, are connected with the windings 28A of the electric motors. Also in this embodiment, the motor boards 39A are constructed so that they can easily be removed. They are held by means of their lower edge in a longitudinal groove of a rail 58 arranged on the shield 56 and, in the area of their upper edge, by means of a clamping holder 59.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning or twisting machine comprising:

a spindle rail constructed as a longitudinal duct, a plurality of spindles arranged in a row adjacent one another and supported via spindle bearings at the spindle rail, and separate electric motors without individual motor housings for driving the respective spindles, said electric motors including stators and rotors, wherein the stators and rotors of the electric motors are disposed in the longitudinal duct in an exposed manner with the spindle rail serving as a protective housing for the stators and rotors to thereby dispense with the need for separate electric motor housings.

2. A spinning or twisting machine according to claim 1, wherein the longitudinal duct means is divided into at least two partial ducts, one partial duct of which containing the exposed stators and rotors, and the other partial duct or ducts containing electric supply lines, control lines and control elements for the electric motors.

3. A spinning or twisting machine according to claim 2, wherein the partial duct containing the electric supply lines, the control lines and the control elements are divided by means of a shield into a strong-current part and a weak-current part.

4. A spinning or twisting machine according to claim 2, wherein the longitudinal duct is joined together from bent metal sheets, and wherein holding parts are mounted on a partition between an upper partial duct and a lower partial duct, the holding parts each carrying spindle bearing housings of the spindles and the stators of the electric motors.

5. A spinning or twisting machine according to claim 3, wherein the longitudinal duct is joined together from bent metal sheets, and wherein holding parts are mounted on a partition between an upper partial duct and a lower partial duct, the holding parts each carrying spindle bearing housings of the spindles and the stators of the electric motors.

6. A spinning or twisting machine according to claim 5, wherein the holding parts have an approximately cup-shaped design, the bottom being provided with a bearing receiving device for one spindle bearing housing respectively, and the wall parts serving as a receiving device for the bundle of laminations of a stator.

7. A spinning or twisting machine according to claim 6, wherein the holding parts are manufactured as die-cast aluminum parts.

8. A spinning or twisting machine according to claim 1, wherein the longitudinal duct consists of an essentially Y-shaped extruded profile, an upper duct section of which accommodates the electric motors and a lower duct section of which houses the electric supply lines, the control lines and the control elements, and wherein the two duct sections are closed by means of detachable lids

9. A spinning or twisting machine according to claim 8, wherein the upper duct section has a horizontal bottom on which spindle bearing housings are held.

10. A spinning or twisting machine according to claim 9, wherein the lower section of the profile has a web projecting downward from the edge of the horizontal bottom to which a leg is connected which extends in parallel and at a distance to the horizontal bottom.

11. A spinning or twisting machine according to claim 10, wherein a web serving as a shield is molded to the leg extending in parallel to the horizontal bottom.

12. A spinning or twisting machine according to claim 9, wherein the stators with their bundles of laminations are fastened to webs of the profile which project upwards from the horizontal bottom.

13. A spinning or twisting machine according to claim 12, wherein the upwardly projecting webs are provided with a profiling in which projections are guided of the bundles of laminations inserted from above.

14. A spinning or twisting machine according to claim 13, wherein the lower section of the profile has a web projecting downward from the edge of the horizontal bottom to which a leg is connected which extends in parallel and at a distance to the horizontal bottom.

15. A spinning or twisting machine according to claim 14, wherein a web serving as a shield is molded to the leg extending in parallel to the horizontal bottom.

16. A spinning or twisting machine according to claim 12, wherein the lower section of the profile has a web projecting downward from the edge of the horizontal bottom to which a leg is connected which extends in parallel and at a distance to the horizontal bottom.

17. A spinning or twisting machine according to claim 1, wherein the longitudinal duct is joined together from bent metal sheets, and wherein holding parts are mounted on a partition between an upper partial duct and a lower partial duct, the holding parts each carrying spindle bearing housings of the spindles and the stators of the electric motors.

18. A spinning or twisting machine according to claim 17, wherein the holding parts have an approximately cup-shaped design, the bottom being provided with a bearing receiving device for one spindle bearing housing respectively, and the wall parts serving as a receiving device for the bundle of laminations of a stator.

19. A spinning or twisting machine according to claim 17, wherein the holding parts are manufactured as die-cast aluminum parts.

20. A spinning or twisting machine according to claim 18, wherein the holding parts are manufactured as die-cast aluminum parts.

21. A textile spinning machine comprising:

a plurality of spindles disposed adjacent to and parallel to one another in a longitudinally extending row, a plurality of respective separate electric driving motors for rotatably driving respective ones of the spindles, each of said driving motors including a respective stator and rotor assembly, and a longitudinally extending housing duct which forms a common protective housing for the stator and rotor assemblies of the plurality of electric motors, said stator and rotor assemblies being disposed in said housing duct without separate individual housings for the respective stator and rotor assemblies of the motors, said housing further forming a spindle rail which bearingly supports the plurality of spindles.

22. A textile spindle machine according to claim 21, wherein said housing duct also forms at least a portion of an electrical cable duct for housing electrical cables which supply current to the electric motors.

23. A textile spindle machine according to claim 21, wherein said housing duct includes an extruded profile wall member which is penetrated by bearing assemblies for the respective spindles.

24. A textile spindle machine according to claim 21, wherein the longitudinally extending duct is joined together from bent metal sheets, one portion of one metal sheet forming a bottom wall of the common protective housing, at which bottom wall the plurality of spindles are bearingly supported, said bearing wall extending over a plurality of said spindles.

25. A textile spindle machine according to claim 24, wherein bearing assemblies for the spindles are supported in cup-shaped spindle bearing receiving devices which are spaced from an other along the length of the bottom wall.

26. A textile spindle machine according to claim 21, wherein the longitudinally extending housing duct is formed as an extruded integral member which forms a bottom wall for accommodating spindle bearings, and sidewalls which directly support the stators for the plurality of electric motors.

27. A textile spindle machine according to claim 26, wherein said extruded member includes a second side wall and second bottom wall underneath the wall supporting the spindle bearings, which last-mentioned walls form a second cut for accommodating electrical cable lines for supplying electricity to the electric motors.

* * * * *